United States Patent [19]

Charron

[11] Patent Number: 4,518,003

[45] Date of Patent: May 21, 1985

[54] PRESSURE RESPONSIVE CAP FOR GAS APPLIANCES

[76] Inventor: Jean-Claude Charron, 14, Ave. du Lac, 94100 Saint-Maur, France

[21] Appl. No.: 460,388

[22] Filed: Jan. 24, 1983

[30] Foreign Application Priority Data

Jan. 25, 1982 [FR] France ..... 82 01060

[51] Int. Cl.[3] ..... F23D 5/16

[52] U.S. Cl. ..... 137/65; 236/99 R; 251/25; 431/85

[58] Field of Search ..... 137/65, 66; 236/68 D, 236/99 G, 99 R; 251/25, 11; 431/85

[56] References Cited

U.S. PATENT DOCUMENTS

| | | | |
|---|---|---|---|
| Re. 20,835 | 8/1938 | Spencer | 137/65 |
| 2,217,419 | 10/1940 | Saul | 137/65 |
| 2,704,648 | 3/1955 | Cobb | 251/25 |
| 2,746,471 | 5/1956 | Cobb | 137/65 |
| 3,204,686 | 9/1965 | Thomson | 236/99 R |

FOREIGN PATENT DOCUMENTS

| | | | |
|---|---|---|---|
| 1301169 | 7/1962 | France . | |
| 1356159 | 2/1964 | France . | |
| 1494853 | 8/1967 | France . | |
| 1344260 | 1/1974 | United Kingdom | 236/68 D |

*Primary Examiner*—George L. Walton

*Attorney, Agent, or Firm*—Kerkam, Stowell, Kondracki & Clarke

[57] ABSTRACT

The invention relates to a pressure responsive assembly for controlling the supply of gas to a gas appliance. A pressure responsive device includes a sealed air bulb positioned to monitor the pilot flame of the appliance. A capillary tube connected at one end to the sealed bulb has its other end supported in the central channel of a small plug. An expandable diaphragm or membrane, having a central aperture aligned with the axis of the plug, is disposed to bear against a button member positioned between the diaphragm and an actuating lever set to control operation of a gas supply valve. The button member is shaped with channels, grooves or apertures to establish a through air connection between the capillary tube and external air when the diaphragm is in a deflated condition.

14 Claims, 5 Drawing Figures

PRESSURE RESPONSIVE CAP FOR GAS APPLIANCES

BACKGROUND OF THE INVENTION

1. Field of the Invention

The present invention relates to control and safety devices for instantaneous gas appliances such as, for example, water heaters, and is more particularly concerned with an improved small safety pressure cap used to control the flow of gas to the pilot of a gas appliance.

2. Description of the Priot Art

Flame-detection devices whose function is to react to the extinguishing of a pilot and stop the admission of gas to the main burner of an appliance, such as an instantaneous water heater or bath heater, operate in accordance with several known and widely applied principles. Among these prior art devices there is a system that not only ensures this safety function, but also permits it to function as a device which directly controls a valve. Such a system includes a pressure responsive cap consisting in known fashion of a small watertight chamfer or bulb filled with air and placed in the flame which is to be detected, and a capillary tube connected to a nipple closed by a small expansible membrane which can be inflated under the effect of the expansion of the air contained in the bulb and which can operate a valve for the admission of gas into the burner.

This system has the advantage of being simple. However, because of the mechanical energy which would be required if it were utilized as a main control device for the admission of gas to the appliance, it is preferable to use such a device downstream of the main control valve as a gas-monitoring and regulating unit, particularly in appliances which produce instantaneous hot water and which operate without a permanent pilot.

In such devices, after a certain period of operation, a drawback arises which is characterized by the fact that, due in particular to the porosity of the small expansible membrane and the difficulty in obtaining effective seals between the bulb and the capillary tube due to the hard rollers and the air contained in the pressure responsive cap tends to escape slowly. As a result, the expansion of the air contained in the pressure responsive cap is no longer sufficient to inflate the membrane and, thereby, to operate the valve that admits gas to the burner.

SUMMARY OF THE INVENTION

The object of the invention is to overcome this drawback by enabling the pressure responsive cap to be filled again with air when the bulb is no longer heated by the flame to be detected.

According to the invention, the small expansible membrane has a central orifice which permits the passage of a pushbutton system which cooperates therewith to enable, under certain conditions, the passage of air from the outside to the inside of the pressure responsive cap by means of said central orifice.

BRIEF DESCRIPTION OF THE DRAWINGS

Other features and advantages of the invention will be better understood from the consideration of the ensuing description taken in connection with the accompanying drawings in which specific embodiments have been set forth for purposes of illustration.

DESCRIPTION OF THE INVENTION

Figure 1:
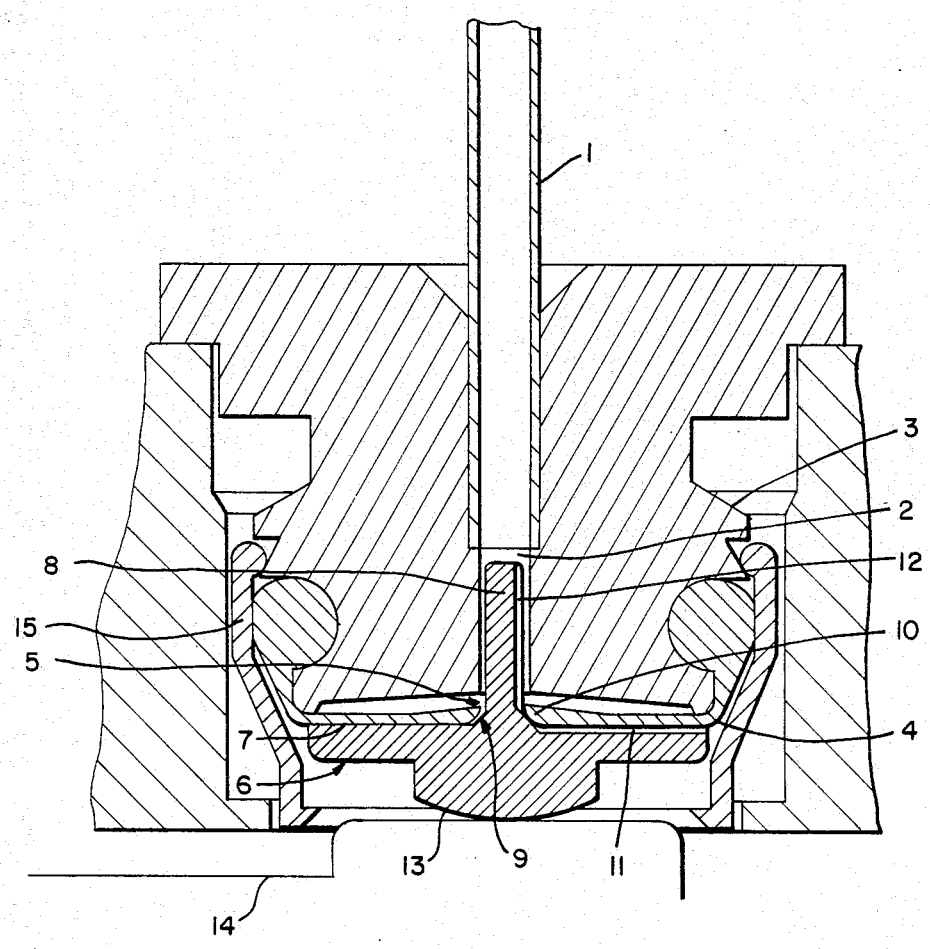
FIG. 1 is a fragmentary elevational view, partially in section, of the pressure responsive cap device of the present invention.

Referring to FIG. 1, the presure responsive device or cap in accordance with the present invention is connected to a flame detector (not shown). The flame detector may take the form of a sealed chamfer or bulb filled with a gas, such as air, for example, and which is connected to one end of a capillary tube 1. The other end of the capillary tube extends into one end of a central passage or channel 2 in a small nipple 3. Fitted in the lower portion of plug 3 is a small expansible membrane 4 having a central aperture which is aligned with the end of channel 2 along its axis and that of tube 1.

This small membrane 4 has one face arranged to bear on the upper horizontal surface (as viewed in the drawing), of a cover plate 7 of piston 6. Piston 6 at its central portion carries a vertical guide rod 8 which passes through the aperture of the membrane 4 and which extends into the channel 2 of plug 3, while the cover plate forms a main supporting surface for the membrane 4.

At the level or junction of the connecting edge between vertical rod 8 and horizontal supporting surface of cover plate 7 piston 6 has a chamfer 9 which serves as bearing surface for the rim 10 which defines the central aperture 5 of membrane 4. The horizontal surface of cover plate 7 has a groove 11 throughout its length. Likewise, vertical stem 8 has a groove 12 throughout its length. These two grooves 11 and 12 are provided on the same side of the piston, one facing the other.

The lower surface of piston 6 as viewed in the drawing has a bulge 13 or button portion having a lower curved surface which bears on a rocking lever 14 (schematically illustrated) connected at one end to control a gas-admitting valve (not shown).

A locking cap 15 fitting tightly around plug 3 supports piston 6 prior to the fitting of lever 14 and serves as a setting for membrane 4 which has its outer upturned bulbous periphery fitted into an annular reduced diameter groove.

Figure 2:
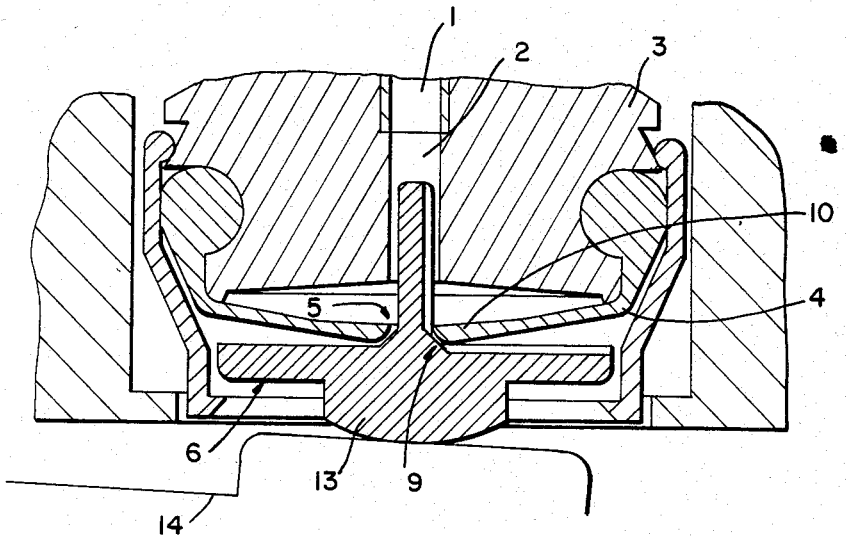
FIGS. 2 and 3 are two fragmentary elevational views, partially in section, of the present invention used to illustrate the operation of the invention.

When the bulb of the pressure responsive cap is heated by a flame, the expansion of the air contained therein acts through tube 1 in the downward direction of the drawinq 6 to inflate membrane 4, as shown in FIG. 2. The rim 10 of membrane 4 is caused to bear sealingly on chamber 9 and causes piston 6 to move downward against rocking lever 14, the movement of lever 14 causing the opening of the gas-admitting valve. Thus, the membrane can be seen to be movable in response to air pressure in the bulb between a first and a second position. In the first position the membrane closes off the passages 10, 11, by pressing against the chamber 9. In the second position of the membrane, the rim 10 separates from the chamber and a continuous channel is formed for passage of air through channel 11, past chamber 9 and channel 12 to capillary 1 and then to the air bulb.

Figure 3:
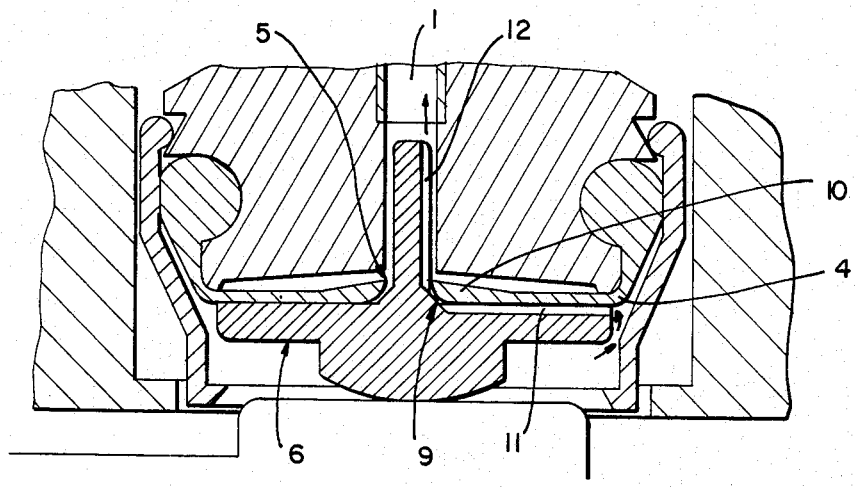

After the apparatus has operated several times, the air contained in the pressure responsive cap tends to escape through osmosis through the membrane or the hard solders between the bulb and the capillary tube, so that immediately when the heating and cooling of the bulb stops, the interior of the pressure responsive cap is in partial vacuum with respect to the atmosphere. Under these conditions, membrane 4 is sucked inwardly as shown in FIG. 3 and the rim 10 works loose from chamber 9 to enable outside air to enter tube 1 and the sensing bulb, passing through grooves 11 and 12. This results in a continuous and automatic filling of air in the pressure responsive cap, thus ensuring proper operation of the device over the course of time.

As soon as the equilibrium of pressures between the inside and outside of the pressure responsive cap is re-established, the membrane resumes it normal position as shown in FIG. 1.

Figure 4:
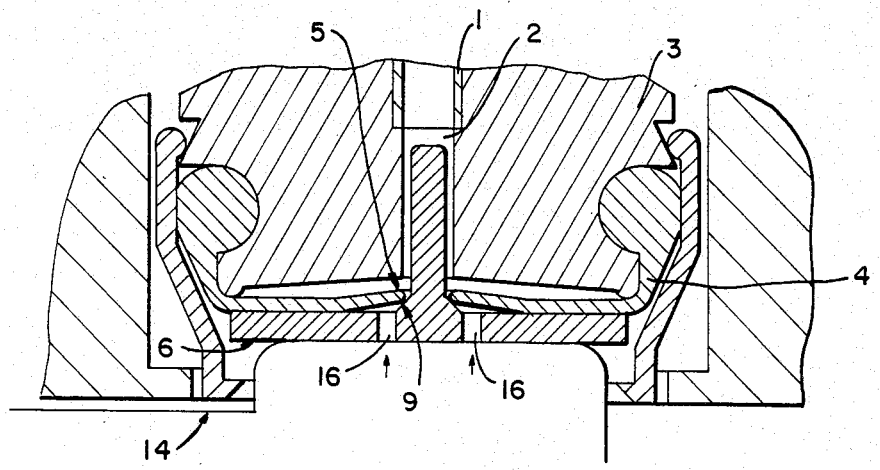
FIGS. 4 and 5 are two fragmentary elevational views, partially in section, of two variant forms of the present invention.
Figure 5:
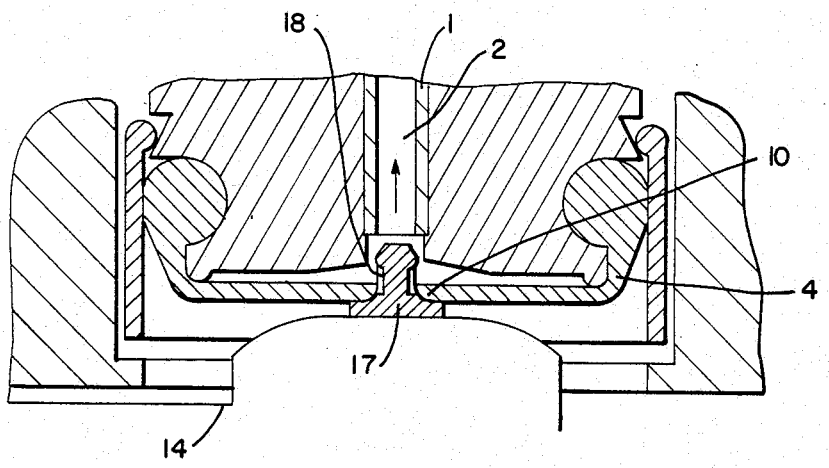

Preference is made to FIGS. 4 and 5 which depict two alternative embodiments of the present invention.

These two embodiments likewise include a capillary tube 1 connected to sink or channel of the small plug 3. Membrane 4 includes a central aperture 5 aligned with the axis of the channel 2. The lever 14 is connected to operatively control a gas-admitting valve.

In the first modification shown in FIG. 4, instead of the grooves 11 and 12 as provided in FIG. 1, the horizontal supporting surface 7 of piston 6 has at least two small apertures 16 for the passage of air as shown by the arrows. The apertures allow air to pass into the space between the stem and rim 10 of membrane 4 as the membrane is sucked toward the surface of the plug. Of course, in this embodiment, the surface of the lever 14 must be constructed so as not to block the air passages. The operation is identical to that described for the preceding embodiment.

In the second modification illustrated in FIG. 5, the piston is replaced by a small stop 17 whose central portion contains small grooves 18. When the interior of the pressure responsive device is in partial vacuum with respect to the atmosphere, membrane 4 and small stop 17 are sucked inwardly in such fashion that the upper surface of the wheel assembly 17 is caused to strike the base or edge of capillary tube 1 in channel 2. At that moment, rim 10 of the membrane works loose from the stop 17 and clears groove 18 for the passage of air, which again fills the pressure responsive device.

As shown, stop 17 includes a base portion which bears against the actuating lever 14 and a reduced diameter head section whose outer diameter freely passes into channel 2 but is greater than the internal diameter of tube 1 to ensure striking of the edge of tube 1 on upward movement of the membrane. The head section and base portion are connected by a spline like stem.

The above embodiments of the invention are far from being all inclusive and are intended only to illustrate that the invention leads itself readily to many embodiments without departing from the spirit of the invention.

What is claimed is:

1. A pressure responsive assembly for controlling the supply of gas to a gas appliance having an air bulb adapted to be positioned in the pilot flame of said appliance, a capillary tube (1) connected at one end to said air bulb and at its other end to a channel (2) of a plug and an expansible membrane supported to the plug (3) for controlling the supply of gas to said gas appliance in response to the movement of said membrane between a first and a second position, the improvement comprising an aperture (5) being defined by a rim porting (10) in said membrane (4) and in alignment with the channel (2) of the plug (3), actuating means (6–17) having at least a portion thereof adapted to be received within said channel, said actuating means having a supporting surface being cooperatively associated with said rim portion (10) and being so constructed and arranged so as to enable external air to flow to the interior of said air bulb through the capillary tube (1) by means of said aperture (5) and through said channel (2) when said membrane (4) is in the second position and to seal the air bulb and capillary tube (1) from said external air when said membrane (4) is in the first position.

2. The assembly as set forth in claim 1 wherein said actuating means (6–17) includes passages (11, 12, 16, 18) adapted to be closed off by said expansible membrane (4) when said membrane (4) is in the first position.

3. The assembly as set forth in claim 2 wherein said passages in said actuating means includes grooves (11, 12, 18) in a member (6) disposed to receive said membrane (4) in bearing relationship therewith.

4. The assembly as set forth in claim 2 wherein said passages include through apertures (16) in a member (6) disposed to receive said membrane in bearing relationship therewith.

5. The assembly as set forth in claim 1 wherein said actuating means is a piston (6) which includes said supporting surface adapted to support said membrane (4) and a rod (8) extending from said surface and passing through said aperture (5) of said membrane and into the channel (2) of said plug (3).

6. The assembly as set forth in claim 5 wherein said supporting surface (7) includes a first groove (11) and said vertical rod (8) includes a second groove (12).

7. The assembly as set forth in claim 6 wherein said first and second grooves (11, 12) are arranged on the same side of said piston (6), one facing the other.

8. The assembly as set forth in claim 5 wherein said supporting surface (7) of said piston (6) includes through air passage apertures for establishing communication between said external air and said bulb.

9. The assembly as set forth in claim 5 wherein said piston (6) has, at the level of the connecting edge between said supporting surface (7) and said extending rod (8), a chamfer (9) in sealing engagement with a rim (10) defining said aperture (5) of said expansible membrane (4).

10. The assembly as set forth in claim 1 wherein said actuating means comprises a stop (17).

11. The assembly as set forth in claim 9 wherein said stop (17) includes air-passage grooves (18) on a central stem portion of said stop (17).

12. An improved pressure responsive device for replenishing air to a sealed air bulb which tends to lose some of the air contained therein comprising a capillary tube having one end connected to the air bulb and a second end connected to a channel in a plug, said plug having an expansible membrane supported thereto, said membrane adapted to be positioned in a first expanded position for closing off the channel in the plug from external air and in a second collapsed position for establishing communication between said channel and external air to said bulb, said membrane having a rim portion defining an aperture and an actuating means for said membrane having a surface portion cooperating with said rim portion when said membrane is in the first position, said actuating means includes a piston-like element, said piston-like element having a flat supporting surface and a rod portion extending in said channel, said flat surface and said rod portion being joined to each other by a chamfer surface, and said rim portion bearing against said chamfer when said membrane is in the first position and being separated therefrom when said membrane is in the second position.

13. A pressure responsive device as set forth in claim 12 further including grooves in said flat surface and rod portion, said grooves being disposed to face each other.

14. A pressure responsive device as set forth in claim 12 further including an atuating lever, said piston being disposed between said actuating lever and said plug for actuation of said lever between a first and a second actuating condition in response to movement of said membrane between its first and its second position, respectively.

* * * * *